US009978395B2

(12) United States Patent
Braho et al.

(10) Patent No.: US 9,978,395 B2
(45) Date of Patent: May 22, 2018

(54) METHOD AND SYSTEM FOR MITIGATING DELAY IN RECEIVING AUDIO STREAM DURING PRODUCTION OF SOUND FROM AUDIO STREAM

(71) Applicant: Vocollect, Inc., Pittsburgh, PA (US)

(72) Inventors: Keith Braho, Murrysville, PA (US); Russell A. Barr, Tarentum, PA (US); George Joshue Karabin, Pittsburgh, PA (US)

(73) Assignee: Vocollect, Inc., Pittsburgh, PA (US)

( * ) Notice: Subject to any disclaimer, the term of this patent is extended or adjusted under 35 U.S.C. 154(b) by 241 days.

(21) Appl. No.: 13/835,638

(22) Filed: Mar. 15, 2013

(65) Prior Publication Data

US 2014/0270196 A1 Sep. 18, 2014

(51) Int. Cl.

| | |
|---|---|
| ***H04R 29/00*** | (2006.01) |
| ***G10L 21/047*** | (2013.01) |
| *G10L 13/08* | (2013.01) |

(52) U.S. Cl.

CPC ..... *G10L 21/047* (2013.01); *G10L 13/08* (2013.01); *H04R 2201/107* (2013.01)

(58) Field of Classification Search

CPC ..... G10L 21/047; G10L 13/00–13/10; G10L 2013/021; G10L 2013/083;

(Continued)

(56) References Cited

U.S. PATENT DOCUMENTS 4,882,757 A 11/1989 Fisher et al.
4,928,302 A 5/1990 Kaneuchi et al.

(Continued)

FOREIGN PATENT DOCUMENTS

EP 0867857 A2 9/1998
EP 0905677 A1 3/1999

(Continued)

OTHER PUBLICATIONS

Smith, Ronnie W., An Evaluation of Strategies for Selective Utterance Verification for Spoken Natural Language Dialog, Proc. Fifth Conference on Applied Natural Language Processing (ANLP), 1997, 41-48.

(Continued)

*Primary Examiner* — Mark Fischer
(74) *Attorney, Agent, or Firm* — Additon, Higgins & Pendleton, P.A.

(57) ABSTRACT

A communication component modifies production of an audio waveform at determined modification segments to thereby mitigate the effects of a delay in processing and/or receiving a subsequent audio waveform. The audio waveform and/or data associated with the audio waveform are analyzed to identify the modification segments based on characteristics of the audio waveform and/or data associated therewith. The modification segments show where the production of the audio waveform may be modified without substantially affecting the clarity of the sound or audio. In one embodiment, the invention modifies the sound production at the identified modification segments to extend production time and thereby mitigate the effects of delay in receiving and/or processing a subsequent audio waveform for production.

24 Claims, 9 Drawing Sheets

(58) Field of Classification Search
CPC .. G10L 2013/105; G10L 21/04–21/049; G10L 21/055; G10L 21/057; G10L 19/025; G10L 21/01
See application file for complete search history.

(56) References Cited

U.S. PATENT DOCUMENTS

| | | | |
|---|---|---|---|
| 4,959,864 | A | 9/1990 | Van Nes et al. |
| 4,977,598 | A | 12/1990 | Doddington et al. |
| 5,127,043 | A | 6/1992 | Hunt et al. |
| 5,127,055 | A | 6/1992 | Larkey |
| 5,230,023 | A | 7/1993 | Nakano |
| 5,297,194 | A | 3/1994 | Hunt et al. |
| 5,349,645 | A | 9/1994 | Zhao |
| 5,428,707 | A | 6/1995 | Gould et al. |
| 5,457,768 | A | 10/1995 | Tsuboi et al. |
| 5,465,317 | A | 11/1995 | Epstein |
| 5,488,652 | A | 1/1996 | Bielby et al. |
| 5,566,272 | A | 10/1996 | Brems et al. |
| 5,602,960 | A | 2/1997 | Hon et al. |
| 5,625,748 | A | 4/1997 | McDonough et al. |
| 5,640,485 | A | 6/1997 | Ranta |
| 5,644,680 | A | 7/1997 | Bielby et al. |
| 5,651,094 | A | 7/1997 | Takagi et al. |
| 5,684,925 | A | 11/1997 | Morin et al. |
| 5,710,864 | A | 1/1998 | Juang et al. |
| 5,717,826 | A | 2/1998 | Setlur et al. |
| 5,737,489 | A | 4/1998 | Chou et al. |
| 5,737,724 | A | 4/1998 | Atal et al. |
| 5,774,841 | A | 6/1998 | Salazar et al. |
| 5,774,858 | A | 6/1998 | Taubkin et al. |
| 5,797,123 | A | 8/1998 | Chou et al. |
| 5,799,273 | A | 8/1998 | Mitchell et al. |
| 5,832,430 | A | 11/1998 | Lleida et al. |
| 5,839,103 | A | 11/1998 | Mammone et al. |
| 5,842,163 | A | 11/1998 | Weintraub |
| 5,870,706 | A | 2/1999 | Alshawi |
| 5,893,057 | A | 4/1999 | Fujimoto et al. |
| 5,893,059 | A | 4/1999 | Raman |
| 5,893,902 | A | 4/1999 | Transue et al. |
| 5,895,447 | A | 4/1999 | Ittycheriah et al. |
| 5,899,972 | A | 5/1999 | Miyazawa et al. |
| 5,946,658 | A | 8/1999 | Miyazawa et al. |
| 5,960,447 | A | 9/1999 | Holt et al. |
| 5,970,450 | A | 10/1999 | Hattori |
| 6,003,002 | A | 12/1999 | Netsch |
| 6,006,183 | A | 12/1999 | Lai et al. |
| 6,073,096 | A | 6/2000 | Gao et al. |
| 6,076,057 | A | 6/2000 | Narayanan et al. |
| 6,088,669 | A | 7/2000 | Maes |
| 6,094,632 | A | 7/2000 | Hattori |
| 6,101,467 | A | 8/2000 | Bartosik |
| 6,122,612 | A | 9/2000 | Goldberg |
| 6,151,574 | A | 11/2000 | Lee et al. |
| 6,182,038 | B1 | 1/2001 | Balakrishnan et al. |
| 6,192,343 | B1 | 2/2001 | Morgan et al. |
| 6,205,426 | B1 | 3/2001 | Nguyen et al. |
| 6,230,129 | B1 | 5/2001 | Morin et al. |
| 6,233,555 | B1 | 5/2001 | Parthasarathy et al. |
| 6,233,559 | B1 | 5/2001 | Balakrishnan |
| 6,243,713 | B1 | 6/2001 | Nelson et al. |
| 6,246,980 | B1 | 6/2001 | Glorion et al. |
| 6,292,782 | B1 | 9/2001 | Weideman |
| 6,330,536 | B1 | 12/2001 | Parthasarathy et al. |
| 6,374,212 | B2 | 4/2002 | Phillips et al. |
| 6,374,220 | B1 | 4/2002 | Kao |
| 6,374,221 | B1 | 4/2002 | Haimi-Cohen |
| 6,377,662 | B1 | 4/2002 | Hunt et al. |
| 6,377,949 | B1 | 4/2002 | Gilmour |
| 6,397,179 | B2 | 5/2002 | Crespo et al. |
| 6,397,180 | B1 | 5/2002 | Jaramillo et al. |
| 6,421,640 | B1 | 7/2002 | Dolfing et al. |
| 6,438,519 | B1 | 8/2002 | Campbell et al. |
| 6,438,520 | B1 | 8/2002 | Curt et al. |
| 6,487,532 | B1 | 11/2002 | Schoofs et al. |
| 6,496,800 | B1 | 12/2002 | Kong et al. |
| 6,505,155 | B1 | 1/2003 | Vanbuskirk et al. |
| 6,507,816 | B2 | 1/2003 | Ortega |
| 6,526,380 | B1 | 2/2003 | Thelen et al. |
| 6,539,078 | B1 | 3/2003 | Hunt et al. |
| 6,542,866 | B1 | 4/2003 | Jiang et al. |
| 6,567,775 | B1 | 5/2003 | Maali et al. |
| 6,571,210 | B2 | 5/2003 | Hon et al. |
| 6,581,036 | B1 | 6/2003 | Varney, Jr. |
| 6,587,824 | B1 | 7/2003 | Everhart et al. |
| 6,594,629 | B1 | 7/2003 | Basu et al. |
| 6,598,017 | B1 | 7/2003 | Yamamoto et al. |
| 6,606,598 | B1 | 8/2003 | Holthouse et al. |
| 6,629,072 | B1 | 9/2003 | Thelen et al. |
| 6,675,142 | B2 | 1/2004 | Ortega et al. |
| 6,701,293 | B2 | 3/2004 | Bennett et al. |
| 6,732,074 | B1 | 5/2004 | Kuroda |
| 6,735,562 | B1 | 5/2004 | Zhang et al. |
| 6,754,627 | B2 | 6/2004 | Woodward |
| 6,766,295 | B1 | 7/2004 | Murveit et al. |
| 6,799,162 | B1 | 9/2004 | Goronzy et al. |
| 6,832,224 | B2 | 12/2004 | Gilmour |
| 6,834,265 | B2 | 12/2004 | Balasuriya |
| 6,839,667 | B2 | 1/2005 | Reich |
| 6,856,956 | B2 | 2/2005 | Thrasher et al. |
| 6,868,381 | B1 | 3/2005 | Peters et al. |
| 6,871,177 | B1 | 3/2005 | Hovell et al. |
| 6,876,987 | B2 | 4/2005 | Bahler et al. |
| 6,879,956 | B1 | 4/2005 | Honda et al. |
| 6,882,972 | B2 | 4/2005 | Kompe et al. |
| 6,910,012 | B2 | 6/2005 | Hartley et al. |
| 6,917,918 | B2 | 7/2005 | Rockenbeck et al. |
| 6,922,466 | B1 | 7/2005 | Peterson et al. |
| 6,922,669 | B2 | 7/2005 | Schalk et al. |
| 6,941,264 | B2 | 9/2005 | Konopka et al. |
| 6,961,700 | B2 | 11/2005 | Mitchell et al. |
| 6,961,702 | B2 | 11/2005 | Dobler et al. |
| 6,985,859 | B2 | 1/2006 | Morin |
| 6,999,931 | B2 | 2/2006 | Zhou |
| 7,031,918 | B2 | 4/2006 | Hwang |
| 7,035,800 | B2 | 4/2006 | Tapper |
| 7,039,166 | B1 | 5/2006 | Peterson et al. |
| 7,050,550 | B2 | 5/2006 | Steinbiss et al. |
| 7,058,575 | B2 | 6/2006 | Zhou |
| 7,062,435 | B2 | 6/2006 | Tzirkel-Hancock et al. |
| 7,062,441 | B1 | 6/2006 | Townshend |
| 7,065,488 | B2 | 6/2006 | Yajima et al. |
| 7,069,513 | B2 | 6/2006 | Damiba |
| 7,072,750 | B2 | 7/2006 | Pi et al. |
| 7,072,836 | B2 | 7/2006 | Shao |
| 7,103,542 | B2 | 9/2006 | Doyle |
| 7,103,543 | B2 | 9/2006 | Hernandez-Abrego et al. |
| 7,203,644 | B2 | 4/2007 | Anderson et al. |
| 7,203,651 | B2 | 4/2007 | Baruch et al. |
| 7,216,148 | B2 | 5/2007 | Matsunami et al. |
| 7,225,127 | B2 | 5/2007 | Lucke |
| 7,266,494 | B2 | 9/2007 | Droppo et al. |
| 7,319,960 | B2 | 1/2008 | Riis et al. |
| 7,386,454 | B2 | 6/2008 | Gopinath et al. |
| 7,392,186 | B2 | 6/2008 | Duan et al. |
| 7,401,019 | B2 | 7/2008 | Seide et al. |
| 7,406,413 | B2 | 7/2008 | Geppert et al. |
| 7,430,509 | B2 | 9/2008 | Jost et al. |
| 7,454,340 | B2 | 11/2008 | Sakai et al. |
| 7,457,745 | B2 | 11/2008 | Kadambe et al. |
| 7,493,258 | B2 | 2/2009 | Kibkalo et al. |
| 7,542,907 | B2 | 6/2009 | Epstein et al. |
| 7,565,282 | B2 | 7/2009 | Carus et al. |
| 7,684,984 | B2 | 3/2010 | Kemp |
| 7,827,032 | B2 | 11/2010 | Braho et al. |
| 7,865,362 | B2 | 1/2011 | Braho et al. |
| 7,895,039 | B2 | 2/2011 | Braho et al. |
| 7,949,533 | B2 | 5/2011 | Braho et al. |
| 7,983,912 | B2 | 7/2011 | Hirakawa et al. |
| 8,200,495 | B2 | 6/2012 | Braho et al. |
| 8,255,219 | B2 | 8/2012 | Braho et al. |
| 8,374,870 | B2 | 2/2013 | Braho et al. |
| 2002/0138274 | A1 | 9/2002 | Sharma et al. |
| 2002/0143540 | A1 | 10/2002 | Malayath et al. |

(56) References Cited

U.S. PATENT DOCUMENTS

| | | | | |
|---|---|---|---|---|
| 2002/0152071 | A1 | 10/2002 | Chaiken et al. | |
| 2002/0178004 | A1 | 11/2002 | Chang et al. | |
| 2002/0198712 | A1 | 12/2002 | Hinde et al. | |
| 2003/0023438 | A1 | 1/2003 | Schramm et al. | |
| 2003/0120486 | A1 | 6/2003 | Brittan et al. | |
| 2003/0191639 | A1 | 10/2003 | Mazza | |
| 2003/0220791 | A1 | 11/2003 | Toyama | |
| 2004/0215457 | A1 | 10/2004 | Meyer | |
| 2005/0049873 | A1 | 3/2005 | Bartur et al. | |
| 2005/0055205 | A1 | 3/2005 | Jersak et al. | |
| 2005/0071161 | A1 | 3/2005 | Shen | |
| 2005/0080627 | A1 | 4/2005 | Hennebert et al. | |
| 2008/0008281 | A1* | 1/2008 | Abrol et al. | 375/359 |
| 2011/0029312 | A1 | 2/2011 | Braho et al. | |
| 2011/0029313 | A1 | 2/2011 | Braho et al. | |
| 2011/0093269 | A1 | 4/2011 | Braho et al. | |
| 2012/0239176 | A1* | 9/2012 | Lien | 700/94 |

FOREIGN PATENT DOCUMENTS

| | | | | |
|---|---|---|---|---|
| EP | 1011094 | A1 | 6/2000 | |
| EP | 1377000 | A1 | 1/2004 | |
| JP | 63179398 | A | 7/1988 | |
| JP | 64004798 | | 9/1989 | |
| JP | 04296799 | A | 10/1992 | |
| JP | 6059828 | A | 4/1994 | |
| JP | 6130985 | A | 5/1994 | |
| JP | 6161489 | A | 6/1994 | |
| JP | 07013591 | A | 1/1995 | |
| JP | 07199985 | A | 8/1995 | |
| JP | 11175096 | A | 2/1999 | |
| JP | 2000181482 | A | 6/2000 | |
| JP | 2001042886 | A | 2/2001 | |
| JP | 2001343992 | A | 12/2001 | |
| JP | 2001343994 | A | 12/2001 | |
| JP | 2002328696 | A | 11/2002 | |
| JP | 2003177779 | A | 6/2003 | |
| JP | 2004126413 | A | 4/2004 | |
| JP | 2004334228 | A | 11/2004 | |
| JP | 2005173157 | A | 6/2005 | |
| JP | 2005331882 | A | 12/2005 | |
| JP | 2006058390 | A | 3/2006 | |
| WO | 2002011121 | A1 | 2/2002 | |
| WO | 2005119193 | A1 | 12/2005 | |
| WO | 2006031752 | A2 | 3/2006 | |
| WO | WO 2011144617 | A1 * | 11/2011 | G01L 21/04 |

OTHER PUBLICATIONS

Kellner, A., et al., Strategies for Name Recognition in Automatic Directory Assistance Systems, Interactive Voice Technology for Telecommunications Applications, IVTTA '98 Proceedings, 1998 IEEE 4th Workshop, Sep. 29, 1998.

Chengyi Zheng and Yonghong Yan, "Improving Speaker Adaptation by Adjusting the Adaptation Data Set"; 2000 IEEE International Symposium on Intelligent Signal Processing and Communication Systems. Nov. 5-8, 2000.

Christensen, "Speaker Adaptation of Hidden Markov Models using Maximum Likelihood Linear Regression", Thesis, Aalborg University, Apr. 1996.

Mokbel, "Online Adaptation of HMMs to Real-Life Conditions: A Unified Framework", IEEE Trans. on Speech and Audio Processing, May 2001.

Silke Goronzy, Krzysztof Marasek, Ralf Kompe, Semi-Supervised Speaker Adaptation, in Proceedings of the Sony Research Forum 2000, vol. 1, Tokyo, Japan, 2000.

Jie Yi, Kei Miki, Takashi Yazu, Study of Speaker Independent Continuous Speech Recognition, Oki Electric Research and Development, Oki Electric Industry Co., Ltd., Apr. 1, 1995, vol. 62, No. 2, pp. 7-12.

Osamu Segawa, Kazuya Takeda, An Information Retrieval System for Telephone Dialogue in Load Dispatch Center, IEEJ Trans. EIS, Sep. 1, 2005, vol. 125, No. 9, pp. 1438-1443.

* cited by examiner

METHOD AND SYSTEM FOR MITIGATING DELAY IN RECEIVING AUDIO STREAM DURING PRODUCTION OF SOUND FROM AUDIO STREAM

TECHNICAL FIELD

The invention relates to producing sound, and more particularly to communication components for producing sound for received audio streams.

BACKGROUND OF THE INVENTION

In speech recognition systems and other speech-based system, a Text-to-Speech (TTS) audio stream is generally created by a TTS engine. A TTS engine takes text data and converts the text into spoken words in an audio stream which may then be played back on a variety of audio production devices, where the audio stream includes an audio waveform and may include other data related to the audio waveform. When used in conjunction with speech recognition circuitry that recognizes a user's speech or speech utterances, a TTS will allow an ongoing spoken dialog between a user and a speech-based system, such as for performing speech-directed work.

Those skilled in the art recognize that a phoneme is the smallest segmental unit of sound employed in a language to form meaningful contrasts between utterances. In the English language, for example, there are approximately 44 phonemes, which when used in combinations may form every word in the English language. A TTS engine generally performs the conversion from text to an audio stream by splitting each word in the text string into a sequence of the word's component phonemes. Then the units of sound for each of the phonemes in the sequence are connected in sequential order into an audio stream that can be played on a variety of sound production devices.

When a TTS engine generates a TTS audio waveform from text, the TTS engine may output metadata that corresponds to the generated audio waveform. This metadata generally contains a text representation of each phoneme provided in the audio stream and may also provide an indication of the position of the phoneme in the audio waveform (i.e. where the phoneme occurs when the audio waveform is produced for listening).

TTS engines and the creation of audio streams based on text data technologies have been widely used in a variety of communication technologies such as automated systems that provide audio feedback and/or instructions to a user. TTS engines and the creation of audio streams based on text data have been used in speech-based work environments to provide workers with audio instructions related to tasks the workers are to perform. In these systems, a worker is typically equipped with a portable terminal device that receives data from a management computer over a communication network, such as a wireless network. The link between the terminal device and the management computer or central system is usually a wireless link, such as Wi-Fi link. The data generally comprises instructions for the worker, either in text or audio format. In these systems, the terminal may convert received text data to an audio stream or the management computer may convert the text to an audio stream prior to transmitting the instructions to the terminal. The generated audio stream may include an audio waveform and metadata associated with the audio waveform, and may be generated using a TTS engine, audio recordings, or a combination.

Generally, the audio stream is produced as sound for the worker through use of a communication component that is in communication with the management computer and/or the terminal device. The communication component may be, for example, a headset having a speaker for production and a microphone for voice input, or similar devices. The audio stream, which includes an audio waveform and has the instructions in audio format, is received by the communication component and produced as sound or speech for the worker.

Conventional systems and methods for producing sound involve playing a storage buffer containing the audio waveform that has been received when a predetermined amount of data has been received. In optimal conditions, playback of the audio waveform by a conventional system will consume more time than it takes to receive a subsequent audio waveform and provide it to a production buffer. Hence, the transition from the audio waveform being produced to the playback of the subsequent audio waveform should occur without any noticeable indication of the transition in the production of the sound to the user of the terminal device and any communication component.

However, in conventional systems, delay in the reception of data, such as a delay from a wireless link, may lead to the situation where audio playback or production of a received audio waveform completes before a subsequent audio stream and audio waveform has been fully received into the buffer. This delay in buffering the audio waveforms often leads to what can be generally described as "choppy" production of sound for the user. Other common descriptions of this occurrence include "skipping," "popping," "stuttering," etc. In short, the delay causes the production of sound to have a delay where production must wait for a subsequent audio stream and audio waveform to be received into the buffer. As mentioned, the cause of the skipping in the production is due to a failure to fully buffer the subsequent audio waveform before production of the previous audio waveform ends. In many communication systems, these breaks in production may be caused by delays in receiving and/or processing the received audio streams, such as over a wireless communication link.

In communication systems that involve producing sound that includes spoken words or speech, the skipping that is due to delay in the system can result in unintelligible or inaccurate sound being produced for a user of the communication component. Depending on the specific application of the communication system that transmits audio feedback and/or instructions to a user, an unintelligible or inaccurate production of audio in the system can render a conventional system unusable for its intended purpose. Overall, the effects of the errors in production described may be considered to affect the quality of the produced sound for a user of the communication component, leading to degraded intelligibility, clarity, usability and/or accuracy.

As discussed, in conventional systems, any delay in receiving and/or processing a subsequent audio waveform leads to skipping. Some techniques can be used to address this issue. Compressing the waveform reduces the time it takes to transfer the waveform and reduces the likelihood that a delay will interrupt playback. However, this is not always adequate and does not address intelligibility when a dropout does occur.

Another technique is to buffer all of or a portion of the waveform on the receiving side before starting playback. The downside of this approach is that it can cause a delay before playback is started while the receiver waits for the waveform to be received. However, this delay is unnecessary in cases when the waveform is transferred at a faster rate than it is being played, so it would be desirable to eliminate it when possible.

Another technique used to address this issue is for the receiver to repeat a portion of the audio. When the receiver of some systems does not receive the next segment of the waveform to be played in time (i.e. before it finishes playing what it has received), it repeatedly plays the last segment of audio that it has received to fill time until it receives the next portion of the waveform. This can prevent the audio from dropping out, but when the portion of the waveform that is repeated is not stationary or periodic, it can produce uneven sounds (clicks and stuttering).

For a wireless headset in industrial environments, when transaction rates are high, the average latency (of delivering verbal instructions to the user wearing a wireless headset) can have a meaningful effect on the value of the system. It can also affect worker acceptance of the system.

Intelligibility and smoothness is also important to the system value and worker acceptance. Difficult to understand and/or choppy audio can cause worker delays and can adversely affect worker acceptance of the system.

Accordingly, there is a need, unmet by conventional communication systems, to address unintelligible or inaccurate production of sound from audio waveforms and speech due to delay in receiving and/or processing in the communication component.

SUMMARY OF THE INVENTION

An apparatus and method are provided to mitigate the effects of delay in receiving and/or processing audio waveform on the quality of production of sound from audio waveforms.

The apparatus includes transceiving circuitry configured to receive an audio stream. The audio stream includes an audio waveform. Memory, such as a buffer, is configured to store the received audio stream. Circuitry is configured to produce sound using the audio waveform. Processing circuitry is configured to analyze the received audio stream and identify at least one modification segment of the audio waveform. The modification segment corresponds to a segment of the audio waveform where production of the audio waveform may be modified to mitigate a delay in receiving the audio stream. The processing circuitry drives production of sound using the audio waveform based at least in part on the identified modification segment.

BRIEF DESCRIPTION OF THE DRAWINGS

The accompanying drawings, which are incorporated in and constitute a part of this specification, illustrate embodiments of the invention and, together with the detailed description of the embodiments given below, serve to explain the principles of the invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF EMBODIMENTS OF THE INVENTION

Embodiments of the invention include systems and methods directed towards improving the intelligibility and clarity of production of sound in communication systems having communication components receiving audio from a communication network and producing sound based on the received audio. More specifically, embodiments of the invention mitigate the effects of delay in receiving and processing audio waveforms by modifying production.

In work environments, a worker may receive an audio stream using a worker communication component connected to a communication network. The audio stream may typically include an audio waveform, where the audio waveform provides audio or speech instructions corresponding to tasks the worker is supposed to perform. Generally, the worker communication component then produces sound based on the audio waveform for the worker using audio production circuitry, such as a speaker, and processing circuitry drives the audio production circuitry to produce the sound based on or using the received audio waveform.

Figure 1:
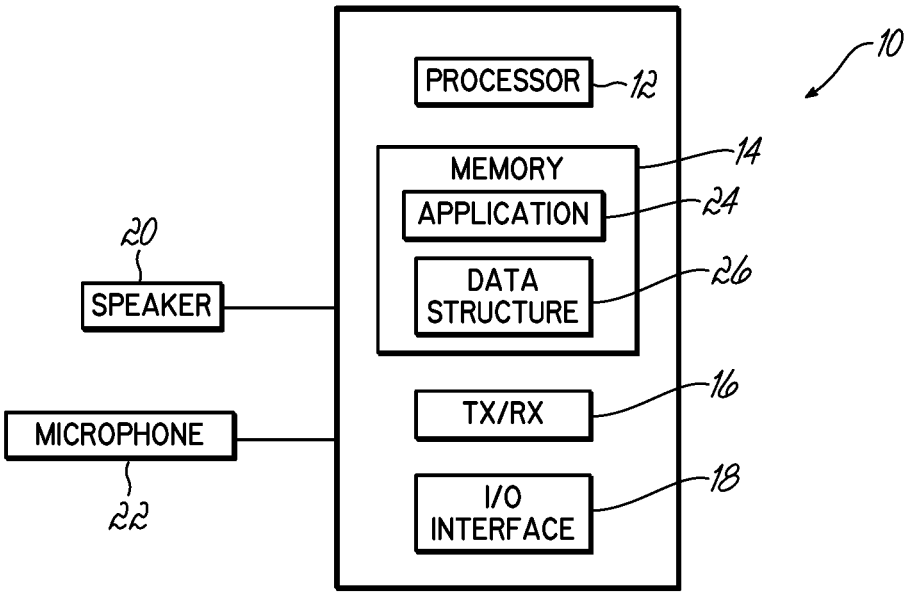
FIG. 1 illustrates a schematic view of an exemplary communication device consistent with embodiments of the invention.

In one exemplary embodiment of the invention, as discussed below, the communication component is in the form of a wireless device that has a wireless link to a computer, such as a portable computer device. However, the overall invention is not limited to such an example. With reference to FIG. 1, there is shown a schematic view of an exemplary worker communication device 10 which may be used with embodiments of the invention. The worker communication device 10 includes a processor 12, a memory 14, transceiver circuitry 16, and input and output interface (I/O interface) circuitry 18. The worker communication component 10 further includes audio production circuitry, such as speaker 20, and may also include a microphone 22 for receiving audio input.

As shown in FIG. 1, memory 14 may include one or more applications 24 and data structures 26. An application 24 may include various instructions, routines, functions, operations and the like to be executed by the processor 12 to adapt the production circuitry 20 to produce sound based on received audio waveforms, in addition application 24 may include instructions, routines, functions, operations and the like which may cause the processor to perform other functions when executed. In embodiments consistent with the invention, memory 14 may include data storage structure 26 configured to hold data readable and writeable by processor 12.

Figure 2:
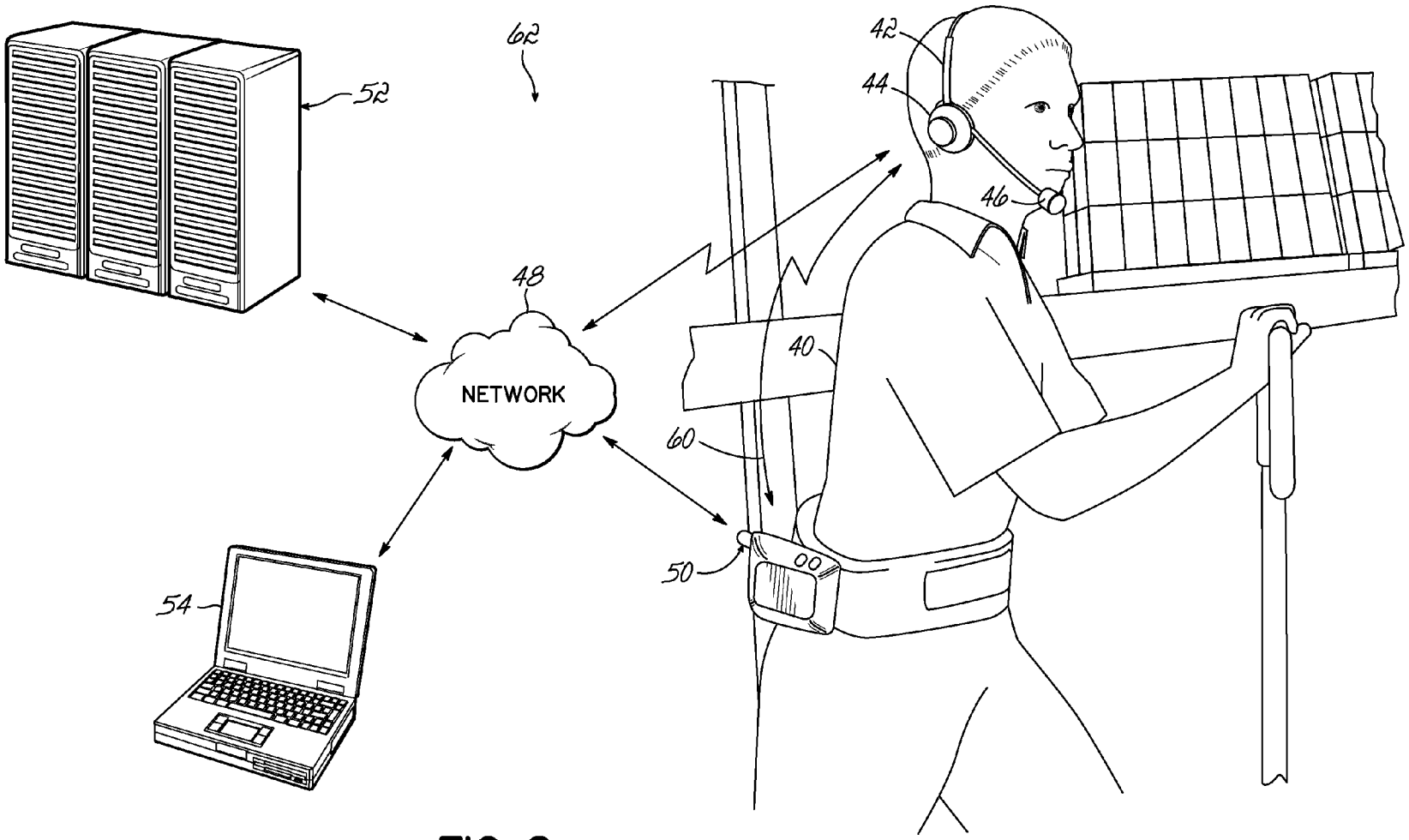
FIG. 2 illustrates worker using a communication device consistent with embodiments of the invention in a communication system.

FIG. 2 is a diagrammatic illustration of a worker 40 using a worker communication device 10, which is shown in FIG. 2 as headset 42. Herein, headset 42 will be described as one embodiment of the device 10 for implementing the invention, but other devices might be used as well. Headset 42 includes speaker 44 for production of sound based on audio waveforms and a microphone 46 for audio input from a worker 40. As shown in FIG. 2, headset 42 is connected to one or more wireless communication networks 48, 60, such that headset 42 may receive an audio stream including an audio waveform for production through the communication network. Headset 42 may be connected to a mobile or portable computer device 50, a remote server computer 52, and/or some other computer device 54 through suitable communication networks. As such, in some embodiments, headset 42 may receive an audio stream from the portable terminal 50, remote computer 52, and/or computer 54 and the headset 42 may generate or produce sound based on the audio waveform included in the received audio stream.

Headset 42 and the various other components coupled therewith through one or more wireless communication networks 48 might implement different networks. For example, in one embodiment of the invention, a wireless headset 42 such as an SRX® device available from Vocollect, Inc. of Pittsburgh, Pa., is used in conjunction with a portable terminal device 50, such as a TALKMAN® device, also available from Vocollect, Inc. Headset 42 may couple directly with terminal device 50 through a suitable short-range network, such as a Bluetooth link, as indicated by link 60, in FIG. 2. Alternatively, headset 42 and terminal device 50 might be linked through another suitable network 48, such as a Wi-Fi network. Generally, in speech-directed work environments, mobile device 50 would be coupled with other elements, such as a remote computer or server 52, or a laptop or PC device 54, as illustrated in FIG. 2. Such links might be done through an appropriate wireless network 48, such as a Wi-Fi network. Then the device 50 will be coupled to headset 42 through another link 60, such as a Bluetooth link. The invention is not limited with respect to how audio signals might be delivered to headset 42 or other device for playback purposes. The invention addresses any delays or latency in any such wireless links used for connection wherein there may be a delay in the headset 42 or other device 10 in receiving the audio stream. The invention mitigates the delay and any degradation of the audio playback from that delay. Accordingly, and in accordance with one aspect of the invention, headset 42 will include appropriate transceiver circuitry, such as circuitry 16, as illustrated in FIG. 1, for communicating with one or more devices through a wireless communication network in order to receive an audio stream, such as from a TTS engine. In that way, the headset 42 or other communication device will wirelessly receive an audio stream, including an audio waveform, in accordance with the invention.

Figure 3:
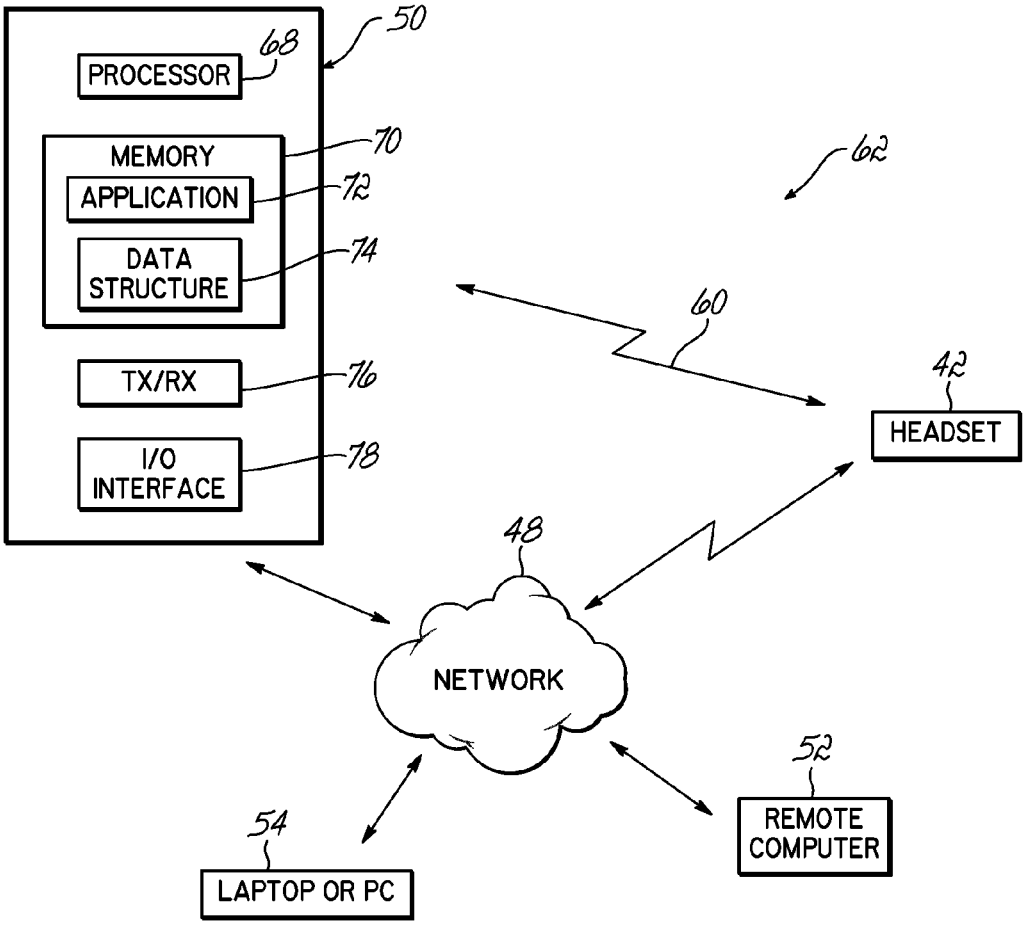
FIG. 3 illustrates a schematic view of the exemplary communication system of FIG. 2.

FIG. 3 provides a more schematic view of a communication system 62 of the diagrammatic illustration of FIG. 2 for practicing the invention. As shown in FIG. 3, a headset 42 and a mobile device 50 are connected over a suitable link 60 or communication network 48. Device 50 may be a mobile or portable computer device, and includes a processor 68 and a memory 70. Memory 70 of device 50 may include one or more applications 72, where applications 72 store sequences of operations, instructions, or the like in the form of program code, where the program code may be executed by the processor 68 to cause the processor to perform one or more operations, steps, processes, subprocesses, or the like. Memory 70 may also include one or more data structures 74, where a data structure 74 may store data, and processor 68 may read and/or write data to data structure 74. In addition, device 50 may include appropriate transceiver circuitry 76 and I/O interface circuitry 78 for interfacing with headset 42 or other elements 52, 54 through wireless links 60 and/or wireless networks 48.

While one exemplary device for practicing the invention is the TALKMAN® device from Vocollect, Inc., as those skilled in the art will recognize, device 50 may comprise any number of devices including a processor and memory, including for example, a personal computer, laptop computer, hand-held computer, smart-phone, server computer, server computer cluster, and the like. Moreover, as shown in FIG. 3, additional computing devices may also be connected through communication network 48, such as laptop computer 54 and a remote computer device 52.

FIGS. 4, 5, 6, 7, 9, 10, 13A, 13B provide flowcharts which illustrate sequences of operations consistent with some embodiments of the invention and that may be performed by some embodiments of the invention. Those skilled in the art will recognize that the sequences of operations illustrated in the blocks of the flowcharts may be removed, added to, and/or performed in alternative sequences without departing from the scope of the invention. Moreover, while the blocks included in the flowcharts are herein described as sequences of operations, those skilled in the art will recognize that the sequences of operations described herein may be embodied in program code, computer instructions, objects, microcontrollers, and the like.

In accordance with one embodiment of the invention, headset 42 acts as a receiver to receive an audio stream, including an audio waveform, to play to a user through a speaker. Such an audio waveform may come from mobile computer device 50, or some other device, as illustrated in FIG. 3. The headset receives the audio stream, which will include an audio waveform for playback, and may include other information. For example, segments of the audio stream, in addition to the audio waveform, may include metadata that is generated by the TTS engine that produced the audio waveform of the audio stream. The metadata segment of any audio stream includes information regarding the word or phoneme sequence that is produced in the audio waveform, along with any synchronization information, which identifies where in the waveform the word or phoneme occurs. Such information might be utilized as noted further hereinbelow for implementing the invention. The audio stream is received through appropriate transceiver circuitry 16 of the headset, or other communication device 10. The processing circuitry including processor 12 and any applications 24 and data structures 26 implemented in operating the headset 42, are configured to determine whether the playback of the audio stream, and particularly the audio waveform of the audio stream, must be modified in order to improve the audio playback and to mitigate any audible effects of delays that may occur in receiving the audio stream from a transmitting device or a transmitter, such as mobile computer device 50, or some other device. To that end, the processing circuitry of the headset is configured to determine if there is a relatively high likelihood that the headset, or other receiver device, will run out of the received audio waveform data while playing the current audio waveform data, thus causing a "skip" in the sound output. Herein, the term "audio waveform" will refer to the sampled audio waveform data that is produced by a TTS engine, including, for example, raw PCM (Pulse Code Modulation) data, or any compressed representations such as ADPCM (Adaptive Differential Pulse Code Modulation), etc. In one embodiment of the invention, compressed audio is used to reduce the bandwidth requirements, at the expense of the computational cost and audio fidelity. For any particular system, a tradeoff will be made between the computational costs of compression, the bandwidth, and reliability of the communication channel, and the audio fidelity requirements.

Figure 4:
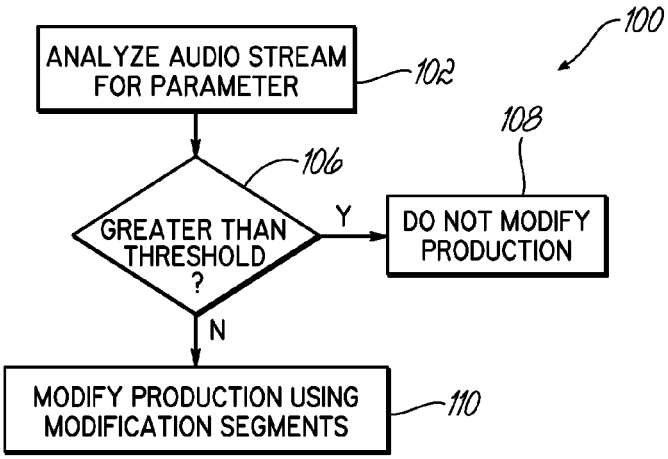
FIG. 4 provides a flowchart illustrating a sequence of operations consistent with embodiments of the invention and executable by a communication device consistent with embodiments of the invention.

With reference to FIG. 4, flowchart 100 illustrates a sequence of operations consistent with embodiments of the invention to determine whether to modify production of an audio waveform. There may not be a need to modify production using modification segments, in accordance with the invention. The communication component processing circuitry analyzes the received audio stream to determine a parameter, such as the production time of the received audio waveform (block 102). That is, the processing circuitry of the headset monitors the time that is required to play the portion of the audio waveform that has already been received, but not yet played. That is, the processing circuitry is configured to evaluate the remaining time for the received audio to play and to determine whether production of sound using the audio waveform will end before a subsequent portion of the audio stream is expected to be received. A parameter, such as this remaining time value, might be compared to a threshold that has been predefined (block 106). The threshold might be dynamically calculated, such as by evaluating the recent history of data throughput in the wireless link. Also, collisions, retries, and wireless signal strength might also be utilized to calculate a suitable threshold to determine how likely it is that the receiver, such as a headset, will run out of audio waveform data to play such that the production of sound ends before additional audio waveform data has been received. In some embodiments, probabilistic models will be used to determine the expected time to receive the next segment with a desired confidence level. Based upon such comparison to a threshold as indicated by decision block 106, the processing circuitry of the headset modifies production of sound using the modification segments of the audio waveform based at least in part on the processing circuitry determining that the production of sound that has been received will end before a subsequent portion of the audio stream is expected to be received. That is, the processing circuitry is configured to determine if there is expected to be a delay, and if so, modify production of the audio. For example, if the parameter, such as the remaining time, does not exceed the threshold, and the received audio may finish playing sooner than desired, then the production is modified. If there is not expected to be a delay (e.g., the threshold is exceeded), the audio production would not be modified, and would play normally (block 108).

In other embodiments of the invention, the communication device processing circuitry determines the expected time needed to receive a subsequent audio stream. That subsequent audio stream might also be a portion of the audio stream that is remaining to be sent, or might be the portion of the audio stream that includes the next modification segment. In some embodiments, determining the expected time needed to receive a subsequent portion of the audio stream from a communication network may include receiving data over the communication network that indicates the size of the subsequent portion of the audio stream and analyzing the received data to determine the size of the subsequent audio stream that is remaining or not yet received. Such information regarding the size of the data may be embedded in the header for that data, for example. In some embodiments, determining the expected time needed to receive a subsequent audio stream may include analyzing data associated with the communication network, where the data may indicate one or more characteristics of the communication network, including, for example, historical transceiving rates of the communication network, bandwidth of the communication network, or other such communication network characteristics. In these embodiments, determining the expected time needed to receive a subsequent portion of the audio stream may be based at least in part on the determined size of the subsequent audio stream and/or one or more communication network characteristics. Such a parameter as the expected time to receive a subsequent portion of the audio stream, might also be compared to a threshold (block 106) to determine if it will be necessary to modify production.

The communication device processing circuitry is configured to determine whether a delay in sound production may occur based on a comparison of the production time of current audio data to the time expected to receive additional or subsequent audio data. That difference might also be compared to a threshold (block 106). Therefore, in some embodiments, the threshold comparison is based on the comparison of the remaining audio versus a threshold. In another embodiment, the expected time to receive the subsequent audio stream or a remaining portion of a current audio stream might be compared to a threshold. In still other embodiments, the communication device circuitry analyzes the determined remaining production time of the audio waveform and also the determined expected time needed to receive the subsequent audio stream or the remaining portion of a current audio stream, and compares it against some threshold, to determine whether production of the audio waveform may end before the subsequent audio stream has been received. As noted, if the communication component determines that production of the audio waveform will not end before receiving the subsequent audio stream, production is not modified (block 108), and would proceed as normal.

However, if the communication device processing circuitry determines that production of the audio waveform may end before the subsequent audio stream or portion of an audio stream will be received, production of the audio waveform may be modified (block 110).

While flowchart 100 has been discussed in a general scenario as a serial progression, the invention is not so limited. As such, the analysis and determining operations discussed above with respect to flowchart 100 may be performed substantially in parallel, such that as the audio waveform is being produced, the communication component is determining the expected time needed to receive the subsequent audio stream, or portion of an audio stream, whether a delay will occur, whether to modify production, etc.

Moreover, in many embodiments, the operations described in flowchart 100 may be repeated or performed continuously, such that the communication component may determine whether to modify production of the audio waveform as the audio waveform is being produced. In these embodiments, the communication device receives and analyzes data indicating network characteristics, data associated with a subsequent audio stream, and other such data to determine whether to modify production of the audio waveform substantially in real-time. As such, the communication component may change between not modifying production and modifying production dynamically and in response to changes in the network characteristics, the subsequent audio stream, etc.

Once it has been determined that modification is necessary, the processing circuitry of the communication device, such as headset 42, is configured to identify those segments in the audio waveform that can be modified without significantly degrading the intelligibility of the produced waveform. In one embodiment of the invention, the processing circuitry is configured to identify segments in the waveform that can be extended and/or repeated without significantly degrading the intelligibility of the waveform. Such identified segments are generally referred to herein as "modification segments", and can be determined in a number of different ways in accordance with aspects of the invention.

Figure 5:
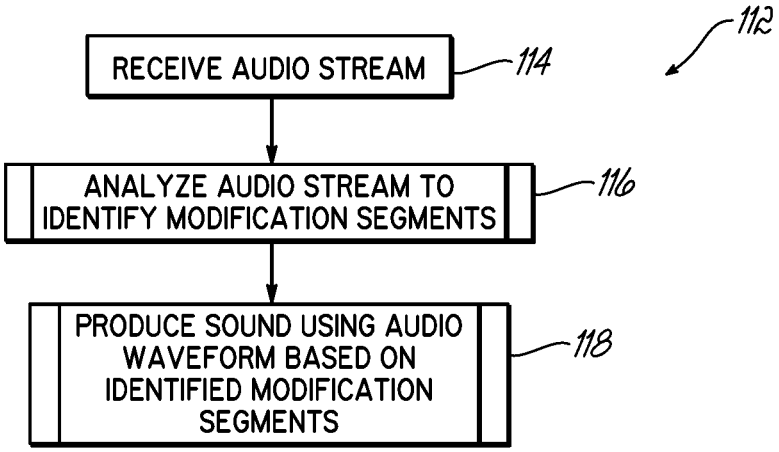
FIG. 5 provides a flowchart illustrating a sequence of operations consistent with embodiments of the invention and executable by a communication device consistent with embodiments of the invention.

Referring now to FIG. 5, flowchart 112 illustrates a sequence of operations that may be performed by a communication device consistent with embodiments of the invention, such as headset 42. The communication device receives an audio stream, where the audio stream includes an audio waveform (block 114) and may include metadata associated with the audio waveform as well. The communication device processing circuitry includes an identification function and is configured to analyze the received audio stream to determine if modification is needed and to identify one or more modification segments for the included audio waveform (blocks 102 and 116).

The identified modification segments of the audio waveform are those segments of the waveform that correspond to portions or parts of the waveform where sound production may be modified while the quality of the sound production may not be substantially affected. As such, production of sound based on or using the audio waveform may be modified at the identified modification segments such that the effects in the production quality due to delays in receiving and/or processing the audio stream may be mitigated. As discussed further below, modification of production includes, for example, in one embodiment, extending a waveform by pausing or delaying production of sound based on the audio waveform for a desired amount of time or time period at one or more modification segments or decreasing the rate of production of sound based on the audio waveform at each modification segment. In another embodiment, certain sounds or portions of the waveform are extended at the modification segments. As such, embodiments consistent with the invention extend the time of production of sound based on the audio waveform thereby increasing the amount of time before production ends, which in turn, allows increased time to receive a subsequent audio stream, and provides such extension in a way that mitigates degradation of sound production quality. As such, the communication device processing circuitry produces sound using the audio waveform based at least in part on the identified modification segments (block 118).

In some embodiments of the invention, the audio stream received from a transmitting component, such as mobile device 50, may include just a sampled audio waveform. In other embodiments, the audio stream may include the sampled audio waveform, along with metadata. The metadata may include the word or phoneme sequence that is produced along with synchronization information and which identifies the places in the waveform that the word or phoneme occurs. In one embodiment of the invention, as discussed further hereinbelow, the metadata is utilized for determining the noted modification segments in the audio waveform. In another embodiment of the invention when the metadata is not available, the processing circuitry of the receiving communication device, such as the headset 42, is configured to analyze the audio waveform looking for suitable modification segments. In accordance with the aspects of the invention, the modification segments are those identified segments for which intelligibility of the produced audio is not substantially reduced when the sound or the lack of sound is extended.

In accordance with embodiments of the invention, a segment of an audio waveform that would fit this criterion includes the natural language pauses or stops between words in the audio waveform. As such, one embodiment of the invention recognizes and utilizes such pauses or stops as the modification segments. Production can be paused at those pauses or stops of the invention and extends those pauses or stops to make them longer pauses. In another embodiment of the invention, the natural stops of the spoken language are used, based upon identified phonemes from the metadata. That is, the natural stops in spoken language, which are often referred to as "voiceless glottal plosives" are used. For example, certain portions of words in English include certain pronunciations where no sound is being produced, such as before the release of air through the vocal tract that would complete the phoneme. Such modification segments could include those phonemes that typically include no sound (stationary), or also those phonemes that might be considered quasi-stationary, as discussed further hereinbelow.

Figure 6:
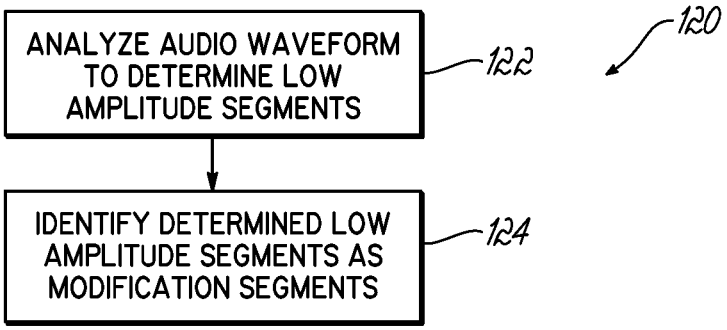
FIG. 6 provides a flowchart illustrating a sequence of operations consistent with embodiments of the invention and executable by a communication device consistent with embodiments of the invention.

Referring to FIG. 6, flowchart 120 illustrates a sequence of operations consistent with embodiments of the invention to identify modification segments in an audio waveform when metadata might not be available. The processing circuitry of a communication device 42 or device 50, such as processors 12, 68 is configured to analyze the audio waveform included in the received audio stream and to determine segments of the waveform having a low level or low amplitude (block 122). The processing circuitry is configured to identify the low level or low amplitude segments as modification segments (block 124). Segments of low amplitude in the audio waveform may correspond, for example, to pauses in the audio waveform (e.g., pauses between words). As such, in these embodiments, the identified modification segments may correspond to pauses between the spoken words or other natural language pauses in the speech being produced. The processing circuitry may be configured to analyze the audio waveform and to look for portions of the waveform that have an amplitude that is less than a certain percentage of the peak amplitude for the waveform, and has a certain minimum duration. For example, the processing circuitry might be configured to analyze the waveform and determine segments that have an amplitude less than 2% of the peak amplitude of the waveform for a minimum duration of 30 milliseconds. Any segment of the audio waveform meeting that criterion might then be identified as a modification segment.

Figure 7:
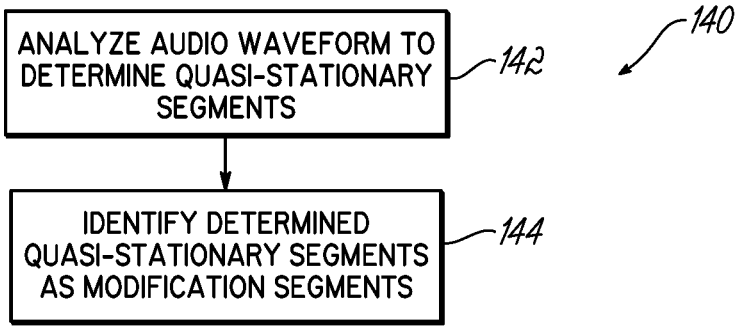
FIG. 7 provides a flowchart illustrating a sequence of operations consistent with embodiments of the invention and executable by a communication device consistent with embodiments of the invention.

FIG. 7 provides flowchart 140 which illustrates another sequence of operations consistent with embodiments of the invention to identify modification segments in an audio waveform. The processing circuitry of the device 42, 50 is configured to analyze the audio waveform included in the received audio stream to determine segments where the audio waveform is quasi-stationary or has quasi-stationary characteristics (block 142). A quasi-stationary segment generally comprises a segment where the amplitude envelope of the audio waveform remains relatively stable for a desired duration of time, as discussed further below. The processing circuitry identifies the quasi-stationary segments as modification segments (block 144).

Figure 8:
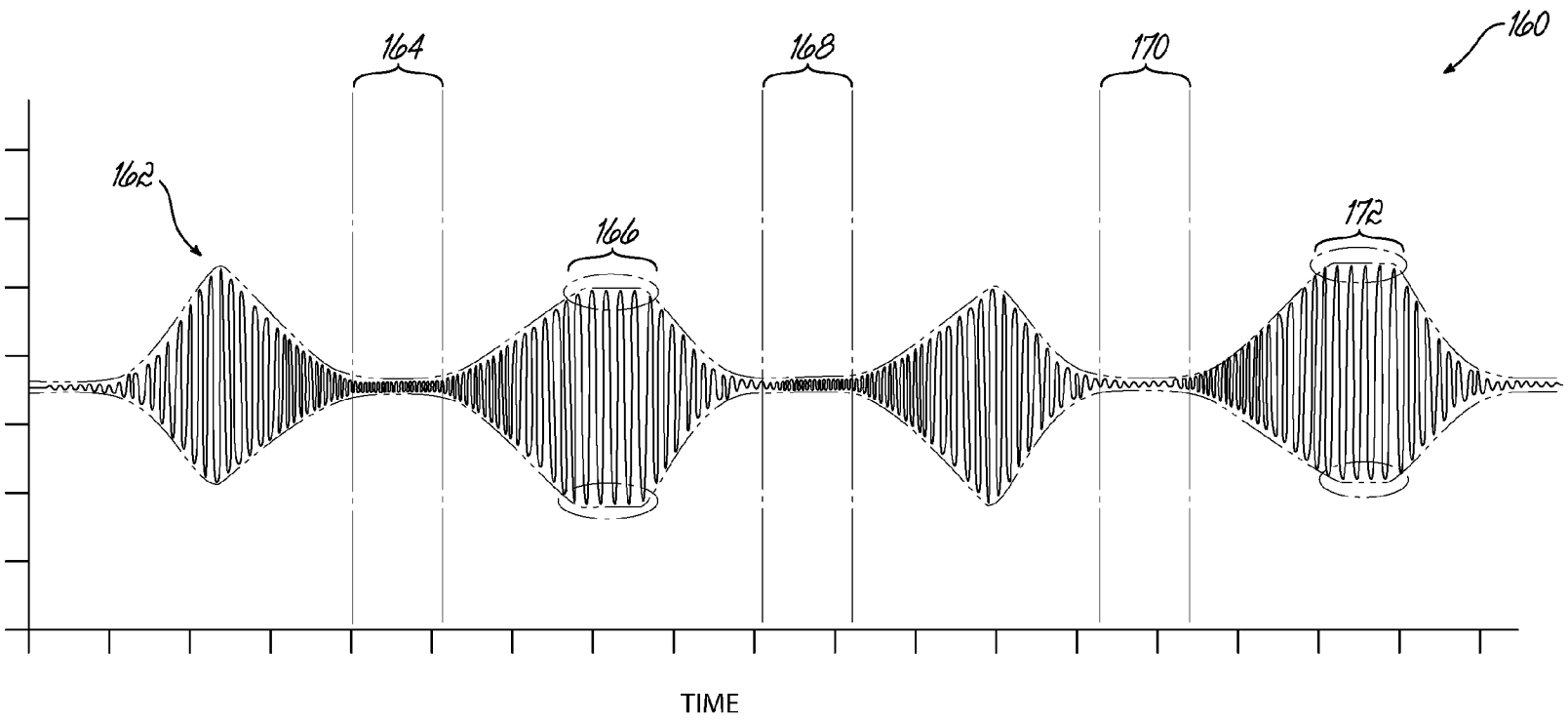
FIG. 8 provides an exemplary graph illustrating a simplified audio waveform that may be analyzed and produced consistent with embodiments of the invention.

FIG. 8 provides an exemplary graph 160 illustrating a simplified audio waveform 162 that might be analyzed by the processing circuitry of device 42. As shown in FIG. 8, portions 164, 166, 168, 170, 172 are present on audio waveform 162. As described above, the processing circuitry analyzes the audio waveform to determine segments of low amplitude in the audio waveform. Such areas of low amplitude, such as segments 164, 168, 170 may correspond to stops or pauses in the audio waveform, such as pauses between words. The processing circuitry is configured to identify those low amplitude segments or pauses as modification segments.

With respect to the exemplary audio waveform 162, the processing circuitry of device 42 is configured to analyze the audio waveform 162 using known signal processing methods to determine segments having low amplitude, such as segments 164, 168, and 170.

As described above, the processing circuitry may be configured to analyze the audio waveform of the received audio stream using known signal processing methods to identify modification segments, where the modification segments correspond to segments of the audio waveform that are quasi-stationary. That is, segments of the audio waveform where the sound is constant or generally constant in its amplitude envelope, or has almost constant short-time energy or almost constant short-time spectrum are considered quasi-stationary. With reference to exemplary audio waveform 162, some embodiments of the invention may analyze the audio waveform 162 and identify segments such as segments 166 and 172 of exemplary audio waveform 162 as modification segments, as discussed above with respect to quasi-stationary segments.

Exemplary graph 160 illustrates a simplified audio waveform 162 for exemplary purposes. In some embodiments consistent with the invention, an audio waveform may be analyzed using known signal processing methods to determine segments that are defined as low-amplitude and/or quasi-stationary. The audio waveform to be produced may be a digitally sampled audio waveform. Those skilled in the art will recognize that a digitally sampled audio waveform comprises data including discrete values which represent the amplitude of an audio waveform taken at different points in time and as such, digital signal processing might be implemented by the processing circuitry of the device 42, 50 doing the analysis.

Figure 9:
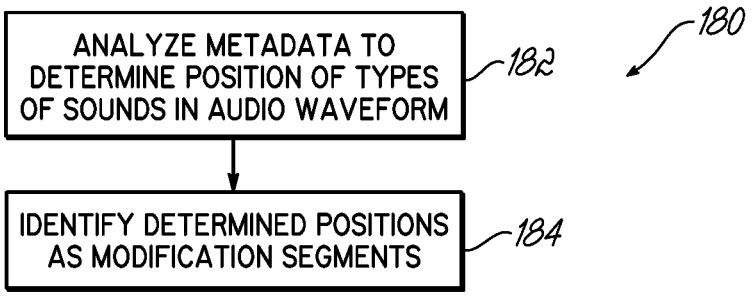
FIG. 9 provides a flowchart illustrating a sequence of operations consistent with embodiments of the invention and executable by a communication component consistent with embodiments of the invention.

FIG. 9 provides flowchart 180 which illustrates a sequence of operations consistent with some embodiments of the invention to identify modification segments in an audio waveform. In some embodiments, the received audio stream may include an audio waveform along with metadata associated with the audio waveform, where the associated metadata indicates the sequence and positions of types of sounds, or a type of sound included in the audio waveform. For example, the particular type or types of sounds might be associated with phonemes in the audio waveform. The processing circuitry of device 42 is configured for analyzing the metadata to determine the position of those modification segments.

As noted above, a TTS engine accepts text as input. The TTS engine then produces a sampled audio waveform corresponding to the input text. The audio waveform is typically in a raw PCM format, which can be written directly to an audio CODEC to then be played by a speaker or other sound production circuitry. In one embodiment of the invention, the TTS may also produce metadata along with the sample audio waveform. The metadata may include the word, phoneme, or sound sequence being produced, along with its synchronization information. The synchronization information identifies where in the waveform the word, phoneme, or sound occurs. As such, the processing circuitry may analyze the associated metadata to determine positions of sound types associated with a desired subset of phonemes or sounds in the audio waveform (block 182). The metadata may also include lip position information being produced, along with its synchronization information. Lip position information is sometimes provided by a TTS to synchronize an avatar's face with the audio. The synchronization information identifies where in the waveform the word or phoneme occurs.

The metadata or subset of phonemes or sounds may correspond to natural pauses in the audio waveform or in pronunciation. Phonemes that have natural pauses or stops in the English language, include for example, the phonemes associated with the letters "t", "p", "k", and "ch" and other phonemes that have segments where no sound is produced (i.e. a pause or period of no sound may occur while speaking a word containing the phoneme). Therefore, the subset of phonemes or sounds may correspond to phonemes with stops that may provide corresponding points to pause production or repeat and/or extend the sound without significantly degrading the quality of the production. Also, quasi-stationary phonemes and sounds may be considered to be types of sounds that may be repeated and/or extended without significantly degrading the quality of the production. For example, in the English language, the sounds associated with phonemes related to vowels (i.e., sounds associated with letters such as "a", "e", "i", "o", and "u"), or fricatives (i.e., sounds associated with the letters such as "v", "f", "th", "z", "s", "y", and "sh") may, to some extent, often be extended or repeated in production without significantly degrading the quality. The processing circuitry is configured to identify segments of the audio waveform that correspond to the middle or quasi-stationary segments of the waveform of the desired phonemes as modification segments (block 184). Likewise, lip position information may be used to identify quasi-stationary segments of the audio waveform. Thus, types of sounds that may be considered modification segments may include, for example, stops, vowels, fricatives, low amplitude and quasi-stationary.

Once the various modification segments for a waveform have been determined, the waveform is produced in order to use those modification segments to extend the waveform. In accordance with one feature of the invention, the waveform may be extended by repeating or elongating the production of the waveform at a particular modification segment. Extending the waveform might also be considered to be performed by repeating or elongating a natural stop or modification segment that corresponds to a low amplitude segment of the waveform. In another aspect of the invention, the sounds associated with phonemes that are quasi-stationary, such as phonemes related to the vowels or fricatives may be extended or repeated for extending the waveform. Note that when extending some waveforms, care must be taken to prevent unnaturally rapid transitions which could cause clicks in the audio. Roucos and Wilgus describe one way to do this in "High Quality Time-Scale Modification for Speech," IEEE Int. Conf. Acoust., Speech, Signal Processing, Tampa, Fla., March 1985, pp. 493-496, which is incorporated herein by reference in its entirety.

Figure 10:
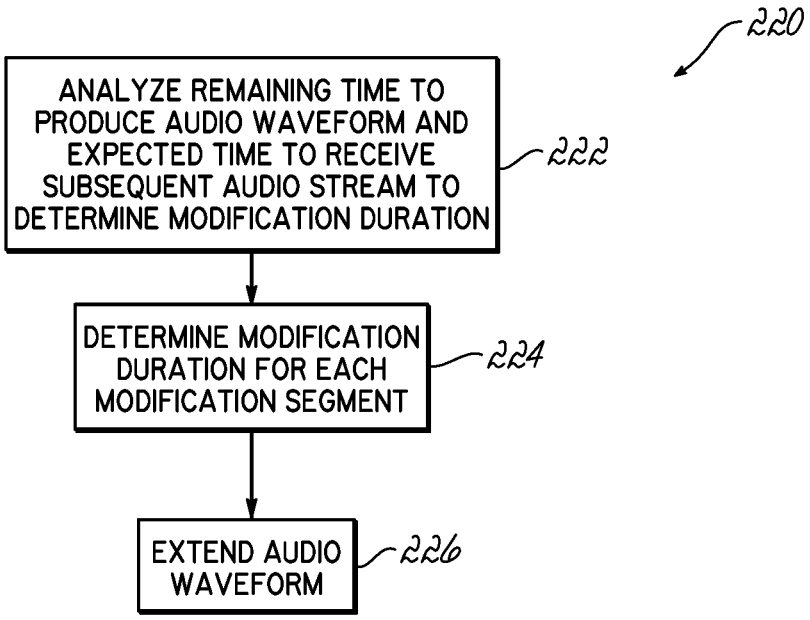
FIG. 10 provides a flowchart illustrating a sequence of operations consistent with embodiments of the invention and executable by a communication device consistent with embodiments of the invention.

FIG. 10 provides flowchart 220, which illustrates a sequence of operations consistent with some embodiments of the invention to modify production of the audio waveform to mitigate effects on the quality of production due to delay in receiving and/or processing a subsequent audio stream or subsequent portion of an audio stream.

In some embodiments, the communication device processing circuitry analyzes the remaining time for production of an audio waveform included in a received audio stream. Also, an expected time to receive a subsequent audio stream might be evaluated to determine a suitable modification duration for a modification step (block 222). As such, the modification duration may be determined as the additional time expected to receive the subsequent audio stream after production of the audio waveform ends. The processing circuitry of the communication device or other device analyzes the identified modification segments of the audio waveform that is queued for production or the identified modification segments of the audio waveform that is currently being produced, and the communication device determines the modification duration, or the amount of time the production of each identified modification segment must be extended such that the total extended production time of the audio waveform will be similar to or greater than the expected time to receive and/or process the subsequent audio stream (block 224).

The communication device processing circuitry is configured to perform one or more operations to thereby extend production of the audio waveform (block 226). In one embodiment of the invention, the processing circuitry is configured to provide such an extension for at least one of the modification segments that have been recognized. Such an extension may be suitable for handling a short delay time for receiving the next subsequent audio waveform. Alternatively, the processing circuitry may recognize multiple modification segments and may provide an extension at each of the multiple segments in order to cumulatively create a delay in the production in the audio waveform for the purposes of the invention. Extending the waveform at a modification segment may take various forms.

In some embodiments, the communication component may extend the waveform by pausing production of sound for a desired amount of time at an identified modification segment. Pausing production at a modification segment may be implemented, for example, when the modification segment indicates a pause or stop in the waveform. As noted above, such a pause or stop may be indicative of a pause between words in the waveform, or might be indicated by a natural language stop for certain phonemes. As such, production might be paused for a desirable delay time at one or more modification segments in order to receive the rest of the audio stream or the subsequent audio stream so that there is not a broken sound production that affects the intelligibility of the sound or speech. As discussed further herein, another embodiment of the invention extends the sound at a particular modification segment. As may be appreciated, pausing production of sound might be considered to be extending the sound or lack of sound associated with a natural pause in the waveform.

In another embodiment of the invention, the communication device processing circuitry is configured to extend the waveform at a modification segment by extending production of sound at one or more identified modification segments. In these embodiments, the sound or lack of sound at each modification segment may be extended, such as by repeating the identified modification segment or the sound associated therewith, such that the reproduction time for the waveform is suitably extended or delayed. Advantageously, extending the sound of a waveform at an identified modification segment may be performed at identified modification segments corresponding to stationary or quasi-stationary segments of the audio waveform. Extending the sound or lack of sound at stationary and/or quasi-stationary segments of the audio waveform, such as by repeating the modification segment at certain portions of the waveform, like a natural language stop, may have a similar effect as essentially pausing production as noted above. Extending the waveform or sound for stationary and quasi-stationary modification segments mitigates any degradation in the quality of the produced sound.

Figure 11A:
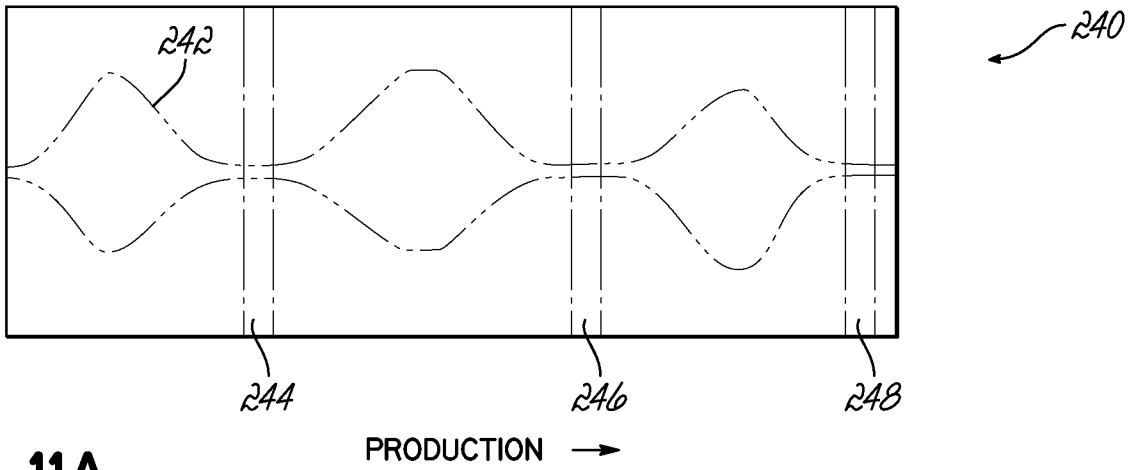
FIG. 11A provides an exemplary audio waveform charted over a production timeline having identified audio modification segments consistent with embodiments of the invention.

FIG. 11A provides an exemplary graph 240, which includes audio waveform envelope 242. Audio waveform envelope 242 is provided for exemplary purposes, and may be considered the envelope of an audio waveform that may be produced by a communication device consistent with embodiments of the invention, where the audio waveform envelope 242 is illustrated with a production timeline. Audio waveform envelope 242 includes exemplary identified modification segments 244, 246, 248, such as modification segments that correspond to pauses in the waveform or areas of low amplitude, such as stationary segments of the waveform.

Figure 11B:
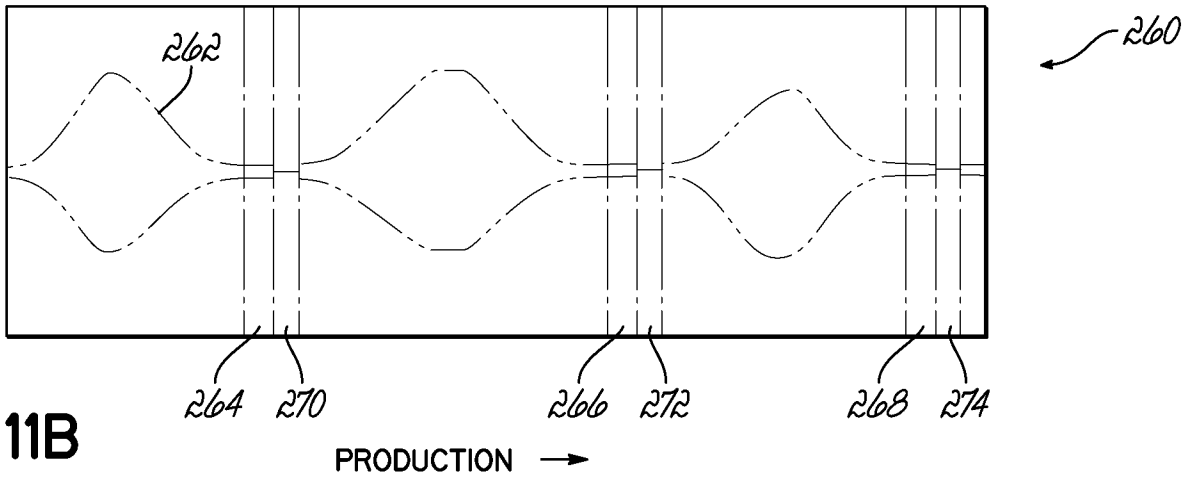
FIG. 11B provides an exemplary audio waveform charted over a production timeline, where the audio waveform of FIG. 11A has been modified to include pauses in production.

FIG. 11B provides exemplary graph 260, which includes audio waveform envelope 262. Audio waveform envelope 262 is provided for exemplary purposes to illustrate a sequence of operations that may be performed by a communication device consistent with embodiments of the invention during production of an audio waveform. As shown in graph 260, audio waveform envelope 262 includes exemplary modification segments 264, 266, 268. As compared to audio waveform envelope 242 of FIG. 11A, audio waveform envelope 262 of FIG. 11B illustrates an example embodiment of the audio waveform envelope 242 with an extended waveform where sound production is paused, in the form of pauses or delays inserted into the production timeline, as discussed above with respect to extending the audio waveform from block 226 of flowchart 220 of FIG. 10. As such, in this example, a communication component consistent with embodiments of the invention has paused sound production by inserting pauses 270, 272, 274 into audio waveform envelope 262, such that the production of the audio waveform corresponding to audio waveform envelope 262 may be extended by the cumulative time value of inserted pauses 270, 272, 274. Inserting pauses might also be considered to be extending the pauses or waveforms at the segments 264, 266, 268. As such, in this example, the time of production of audio waveform block 262 exceeds the time of production of audio waveform block 242 of FIG. 11A by the cumulative time value of the inserted pauses 270, 272, 274. Alternatively, the invention might provide a somewhat similar result by extending or repeating the low level signal for the time periods 270, 272, 274, as discussed below. Pausing production of sound or extending a natural pause or a low level signal will introduce the desired delay in the waveform to extend the audio waveform.

Figure 12A:
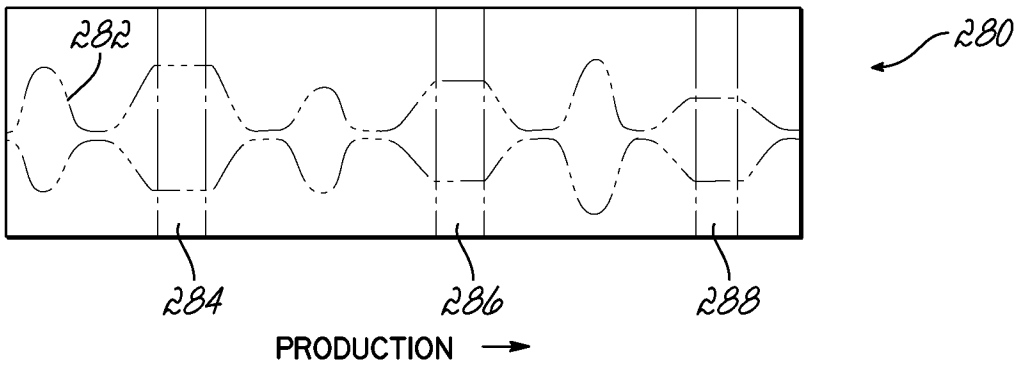
FIG. 12A provides an exemplary audio waveform charted over a production timeline having identified audio modification segments consistent with embodiments of the invention.

FIG. 12A provides exemplary graph 280, which includes audio waveform envelope 282. Audio waveform envelope 282 is provided for exemplary purposes, and may be considered to represent an audio waveform that may be produced by a communication device consistent with embodiments of the invention, where the audio waveform envelope 282 is illustrated with a production timeline. Audio waveform envelope 282 includes exemplary identified modification segments 284, 286, 288. The modification segments correspond to segments of the waveform that might be considered quasi-stationary.

Figure 12B:
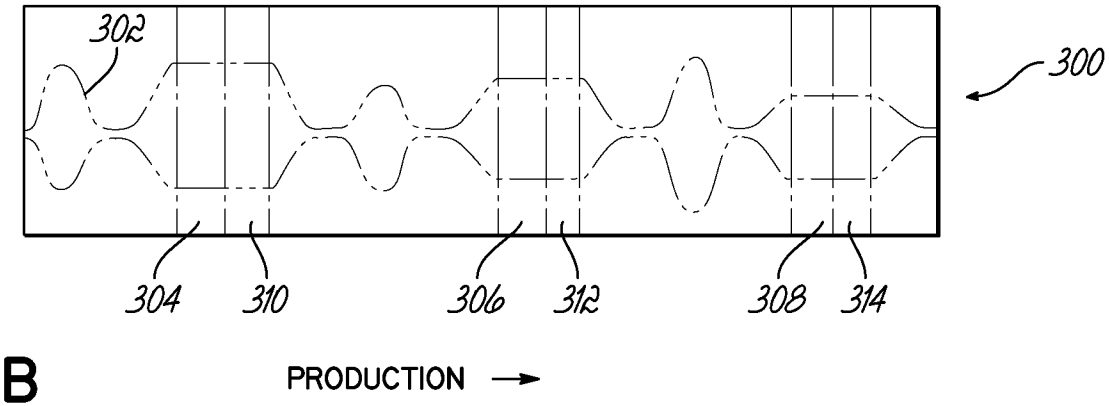
FIG. 12B provides an exemplary audio waveform charted over a production timeline, where the audio waveform of FIG. 12A has been modified to include extended segments in production.

FIG. 12B provides exemplary graph 300, which includes audio waveform envelope 302, which provides an example of extending a waveform at identified modification segments as described above with respect to block 226 of FIG. 10. As shown in graph 300, audio waveform envelope 302 includes exemplary identified modification segments 304, 306, 308 which correspond to exemplary identified modification segments 284, 286, 288 of FIG. 12A. In addition, audio waveform envelope 302 includes repeated segments 310, 312, 314 that provide an extension of the waveform at the modification segments 304, 306, 308. The repeated segments 310, 312, 314 extend the sound represented by the identified modification segments 304, 306, 308, respectively. As compared to audio waveform envelope 282 of FIG. 12A, audio waveform envelope 302 of FIG. 12B illustrates an example embodiment of the audio waveform envelope 282 with repeated segments inserted into the production timeline to extend the waveform, as discussed above with respect to block 226 of flowchart 220 of FIG. 10. For example, the extension of the waveform may correspond to the extension or repetition of the quasi-stationary segment or sound of the audio so that the intelligibility of the audio is not substantially degraded. As such, in this example, a communication component consistent with embodiments of the invention has inserted repeated segments 310, 312, 314 into audio waveform envelope 302, such that the production of the audio waveform corresponding to audio waveform envelope 302 may be extended by the time value of the inserted segments 310, 312, 314. As such, in this example, the time of production of audio waveform envelope 302 exceeds the time of production of audio waveform block 282 of FIG. 11A by the cumulative time value of the segments 310, 312, 314.

While FIGS. 11A,11B, 12A and 12B illustrate the exemplary identified modification segments substantially equal in time duration, the invention is not so limited. As is generally known in the relevant field, the modification segments may vary in production time duration, as the various characteristics that are used to identify the modification segments vary. For example, the production time duration of a phoneme indicating a pause generally depends on the typical time required to pronounce the phoneme, which generally varies. Likewise, a phoneme indicating a quasi-stationary segment generally depends on the typical time required to pronounce the phoneme, which would likewise generally vary. Moreover, those skilled in the art will recognize that analysis parameters may be defined which require a segment of low amplitude or a quasi-stationary segment to have a minimum production time duration in order to be identified as a modification segment as discussed herein.

Furthermore, the exemplary FIGS. 11A, 11B, 12A, 12B, also show multiple modification segments that are used for extending the waveform. However, only a single modification segment might be needed for the proper delay and extension of the waveform. Therefore, the invention is not limited to the number of modification segments that might be recognized in the processing, nor the number of modification segments that might be used to pause production of sound or to repeat or insert segments for the purpose of extending the waveform in order to introduce the desired delay. For example, every possible modification segment that exists or is identified does not have to be used to extend the waveform.

Modification of production has been illustrated in the exemplary figures discussed above corresponding to modification segments that are repeated or inserted and have substantially equal duration, but the invention is not so limited. As such, a communication device consistent with embodiments of the invention may vary the modification duration or length of the pause or repeated or extended segments as necessary during production at the identified modification segments in order to achieve the desired waveform extension. For example, the duration of the inserted pauses or repeated or extended segments might vary based at least in part on how long it is expected to take to receive the subsequent portion of the waveform with the next modification segment and/or other variables, including for example, the production time duration of the identified modification segment, the type of modification segment identified, the specific sound or phoneme corresponding to the identified modification segment, etc.

The invention has been described herein with respect to the processing circuitry of the communication component, such as a headset, but the invention is not so limited. In some embodiments consistent with the invention, analysis and identification of the audio stream may be performed by a remote computer, portable terminal or other such transmitting devices and the processing circuitry therein. In these embodiments, modification data indicating the position of the identified modification segments in an audio waveform may be included in an audio stream along with the associated audio waveform for transmission to the communication device, such as a headset. In some embodiments, the communication device, such as the headset, may then analyze the transmitted modification data, and the communication component may then modify sound production based on the transmitted analyzed modification data of the received audio stream.

Figure 13A:
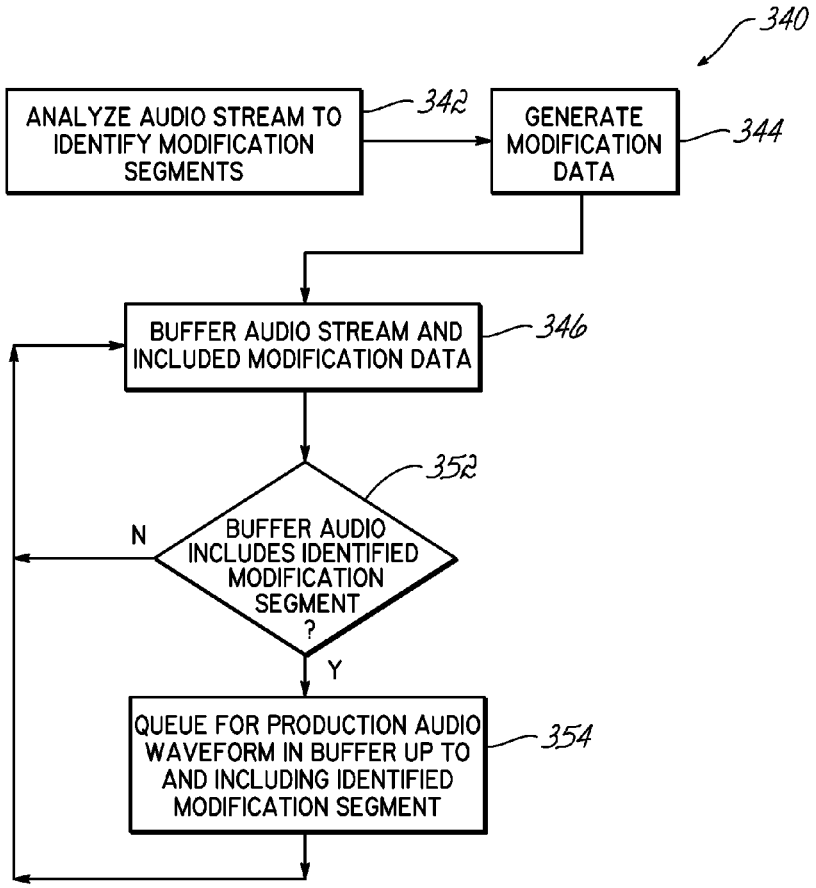
FIG. 13A provides a flowchart illustrating a sequence of operations consistent with embodiments of the invention and executable by a communication device consistent with embodiments of the invention.

FIG. 13A provides flowchart 340, which illustrates a sequence of operations that may be performed consistent with an alternative embodiment of the invention. In flowchart 340, an audio stream is analyzed by a processing device. The analysis could be done at a communication device like headset 42, or could be done prior to transmission to a communication device, such as headset 42, consistent with embodiments of the invention. For example, referring to FIG. 2, the audio stream may be analyzed by the mobile device 50, remote computer 52, and/or mobile computer 54 to identify modification segments that might be used to extend the waveform consistent with the described invention. In that case, the transmitting device would include the processing circuitry configured for such analysis. The analyzed audio stream, along with information regarding the modification segments, may then be transmitted to be received by the communication device 42 over the communication network.

A computer or processing device (e.g., a headset, a portable terminal, mobile computer, remote computer, smart-phone, tablet computer, or other such device) analyzes an audio stream, as noted, to identify modification segments of the audio waveform (block 342). As discussed previously, the audio stream includes an audio waveform and may include metadata associated with the audio waveform, and the analysis of the audio stream may include analyzing the audio waveform and/or the associated metadata to indicate suitable modification segments.

The processing or computer device generates modification segment data based at least in part on the identified modification segments (block 344), where the modification data indicates the position of modification segments in the audio waveform included in the audio stream. If the processing occurs at a location (e.g., device 50) other than where the sound is produced, (e.g., the headset), the computing or processing device may package the generated modification data in the audio stream as header data for the included audio stream, such that the modification data will be read by a production device (e.g., headset 42) prior to producing the included audio waveform. As such, in these embodiments, when the audio waveform is loaded for sound production, the position of the modification segments in the audio waveform will be identified for the receiving and producing device.

The analyzed audio stream and modification data are stored in a buffer data structure of the memory of the communication device 42 (block 346). If the analyzed audio stream is sent from another device, the audio stream might be stored in a buffer data structure in the memory of the communication component as the audio stream is received.

The communication component dynamically monitors the audio stream and modification data in the buffer to determine if the buffered audio waveform includes any identified modification segments (block 352). In response to determining that the buffered audio waveform includes modification segments, the communication device queues up for production the audio waveform up to and including the last identified modification segment stored in the buffer, While the communication device 42 produces the audio waveform it has received, the communication device continues to transceive and buffer a subsequent audio stream or a continuing portion of an audio stream (block 346), such that production of the subsequent audio stream may begin following the end of production of the previous audio stream or previous audio stream portion. As discussed previously, in accordance with the invention, the communication device 42 may modify production of the loaded audio waveform at the identified modification segments appropriately to mitigate delays in receiving and processing the remaining or subsequent audio stream or audio stream portion. Thus, in these embodiments, the communication component may modify the production to extend the waveform as appropriate such that the production time is extended, thereby extending the time that a subsequent audio stream may be received and buffered.

Therefore, in some embodiments, the communication device 42 may delay production until the buffer includes at least one modification segment or the buffer is full. In these embodiments, production of sound is generally delayed at the noted modification segments as opposed to random locations in an audio waveform that coincide with the end of the buffer. This improves the quality of the production, while also increasing the speed at which production may begin by not waiting for as much data to be received as would otherwise be needed to mitigate choppiness.

Figure 13B:
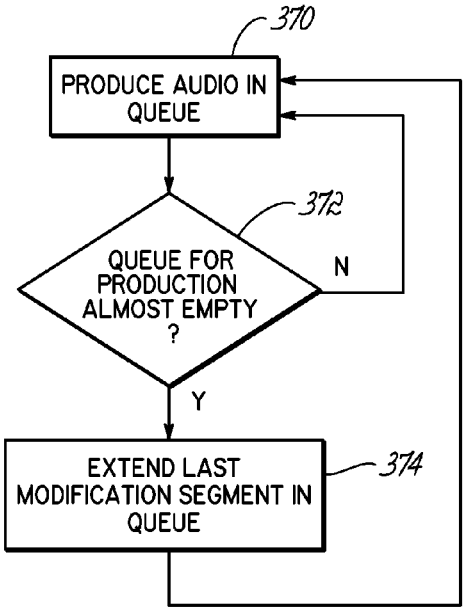
FIG. 13B provides a flowchart illustrating a sequence of operations consistent with embodiments of the invention and executable by a communication device consistent with embodiments of the invention.

Accordingly, as the waveform data is buffered and placed in a queue as illustrated in FIG. 13A, the communication device addresses and produces the audio in the queue, as illustrated in the flowchart of FIG. 13B. Specifically, the communication device produces audio in the production queue (block 370). If the production queue is almost empty (block 372), the waveform is extended at the last modification segment in the queue (block 374). The test of whether the queue is almost empty may be based upon analyzing the amount of waveform data that remains to be produced, as well as the time that it is expected to take to receive subsequent data, as noted above. After these steps, regardless of whether the production queue was almost empty or not, production of audio from the production queue continues (block 370). By extending the waveform at the modification segment in the queue before the queue empties, audio dropouts and stuttering are prevented.

The modification segments can be identified before or after the audio stream is sent over the communication channel, and the invention is not limited to either scenario, and would cover both. The identification of modification segments could be done before the audio stream is transmitted, or could be done at the receiver, after the audio stream has been received. Therefore, the flow of chart 340 in FIG. 13A might provide such analysis and processing after the audio streams are transmitted to the communication component that produces the audio.

While embodiments of the invention have been illustrated by a description of the various embodiments and the examples, and while these embodiments have been described in considerable detail, it is not the intention of the applicants to restrict or in any way limit the scope of the appended claims to such detail. Additional advantages and modifications will readily appear to those skilled in the art. Thus, embodiments of the invention in broader aspects are therefore not limited to the specific details, representative apparatus and method. Moreover, any of the blocks of the above flowcharts may be deleted, augmented, made to be simultaneous with another, combined, or be otherwise altered in accordance with the principles of the embodiments of the invention. Accordingly, departures may be made from such details without departing from the scope of applicant's general inventive concept.

Other modifications will be apparent to one of ordinary skill in the art. Therefore, the invention lies in the claims hereinafter appended.

What is claimed is:

1. An apparatus comprising:

transceiver circuitry configured to receive an audio stream, the audio stream including an audio waveform;

a memory configured to store the received audio stream;

audio production circuitry configured to produce sound using the audio waveform;

processing circuitry configured to:

analyze the received audio stream and identify a modification segment of the audio waveform, the modification segment being a segment of the audio waveform where production of the audio waveform may be modified to mitigate a delay in receiving the audio stream by temporally extending the modification segment without substantially affecting clarity of the produced sound, and drive production of sound using the audio waveform based at least in part on the modification segment that was identified;

wherein the audio stream includes metadata associated with the audio waveform that indicates a position of a specific type of sound included in the audio waveform, and the processing circuitry is configured to analyze the associated metadata to identify the modification segment having the position within the specific type of sound; and wherein the specific type of sound is phonemes having natural pauses, phonemes having voiceless glottal plosives, phonemes related to vowels, phonemes related to fricatives, quasi-stationary audio waveform segments of phonemes, middle audio waveform segments of phonemes, lip positions having natural pauses, or lip positions having voiceless glottal plosives.

2. The apparatus of claim 1 wherein the processing circuitry is configured to extend the audio waveform at the identified modification segment.

3. The apparatus of claim 2 wherein the processing circuitry is configured to analyze remaining time to produce sound using a received audio waveform and the expected time to receive a subsequent portion of an audio stream and to determine the duration for the extension of the audio waveform.

4. The apparatus of claim 2, wherein the processing circuitry is configured to extend the audio waveform by pausing production of sound at the identified modification segment of the audio waveform for a desired time period.

5. The apparatus of claim 2, wherein the processing circuitry is configured to extend the audio waveform by repeating the identified modification segment to extend the sound represented by the identified modification segment.

6. The apparatus of claim 1, wherein the identified modification segment corresponds to a segment of low amplitude in the audio waveform.

7. The apparatus of claim 1 wherein the processing circuitry is configured to drive production of sound by delaying production of sound until the modification segment is identified.

8. The apparatus of claim 1, wherein the identified modification segment corresponds to a segment of the audio waveform where the audio waveform is quasi-stationary.

9. The apparatus of claim 1, the processing circuitry being further configured to:

determine whether production of sound using the audio waveform will end before a subsequent portion of the audio stream is expected to be received, and drive production of sound using the audio waveform based at least in part on the processing circuitry determining that the production of sound using the audio waveform will end before a subsequent portion of the audio stream is expected to be received.

10. The apparatus of claim 1, the processing circuitry being further configured to:

determine whether production of sound using the audio waveform will end before a subsequent portion of the audio stream with an identified modification segment is expected to be received, and drive production of sound using the audio waveform based at least in part on the processing circuitry determining that the production of sound using the audio waveform will end before a subsequent portion of the audio stream with an identified modification segment is expected to be received.

11. A system comprising:

a transmitting device for transmitting an audio stream including an audio waveform;

a receiving device for receiving the audio stream including audio production circuitry configured to produce sound using the audio waveform of the audio stream;

processing circuitry of the transmitting device configured to analyze the audio stream and identify a modification segment of the audio waveform, the modification segment being a segment of the audio waveform where production of the audio waveform may be modified to mitigate a delay when the receiving device receives the audio stream by temporally extending the modification segment without substantially affecting clarify of the produced sound; and processing circuitry of the receiving device configured for driving the production of sound using the audio waveform based at least in part on the modification segment that was identified;

wherein the audio stream includes metadata associated with the audio waveform that indicates a position of a specific type of sound included in the audio waveform;

wherein the processing circuitry of the transmitting device is configured to analyze the associated metadata and identify modification segment having the position within the specific type of sound; and wherein the specific type of sound is phonemes having natural pauses, phonemes having voiceless glottal plosives, phonemes related to vowels, phonemes related to fricatives, quasi-stationary audio waveform segments of phonemes, middle audio waveform segments of phonemes, lip positions having natural pauses, or lip positions having voiceless glottal plosives.

12. The system of claim 11 wherein the processing circuitry of the receiving device is configured to extend the audio waveform at the identified modification segment.

13. The system of claim 12, wherein the processing circuitry is configured to extend the audio waveform by pausing production of sound at the identified modification segment of the audio waveform for a desired time period.

14. The system of claim 12, wherein the processing circuitry is configured to extend the audio waveform by repeating the identified modification segment to extend the sound represented by the identified modification segment.

15. The system of claim 11, wherein the identified modification segment corresponds to a segment of low amplitude in the audio waveform.

16. The system of claim 11, wherein the identified modification segment corresponds to a segment of the audio waveform where the audio waveform is quasi-stationary.

17. A method of producing sound from an audio waveform, the audio waveform being included in a received audio stream, the method comprising:

analyzing the audio stream to identify a modification segment of the audio waveform, the modification segment being a segment of the audio waveform where production of the audio waveform may be modified to mitigate a delay in receiving the received the audio stream by temporally extending the modification segment without substantially affecting clarity of the produced sound;

producing sound using the audio waveform based at least in part on the modification segment that was identified;

wherein the audio stream includes metadata associated with the audio waveform that indicates a position of a specific type of sound included in the audio waveform;

analyzing the associated metadata; and identifying the modification segment having the position within the specific type of sound, the specific type of sound being phonemes having natural pauses, phonemes having voiceless glottal plosives, phonemes related to vowels, phonemes related to fricatives, quasi-stationary audio waveform segments of phonemes, middle audio waveform segments of phonemes, lip positions having natural pauses, or lip positions having voiceless glottal plosives.

18. The method of claim 17 further comprising extending the audio waveform at the identified modification segment and producing sound using the extended audio waveform.

19. The method of claim 18 further comprising analyzing remaining time to produce sound using the received audio waveform and the expected time to receive a subsequent portion of an audio stream and to determine the duration for the extension of the audio waveform.

20. The method of claim 18 including pausing production of sound at the identified modification portion of the audio waveform for a desired time period to extend the audio waveform.

21. The method of claim 18 including extending the waveform by repeating the identified modification segment to extend the sound represented by the identified modification segment.

22. The method of claim 17, wherein analyzing the audio stream includes analyzing the audio waveform to determine a segment of the audio waveform having a low amplitude, and identifying a segment of low amplitude as a modification segment.

23. The method of claim 17, wherein analyzing the audio stream includes analyzing the audio waveform to determine a segment of the audio waveform where the audio waveform is quasi-stationary, and identifying a quasi-stationary segment as a modification segment.

24. The method of claim 17, further comprising:

determining whether production of sound using the audio waveform of the received audio stream will end before a subsequent portion of the audio stream is expected to be received; and producing the sound using the audio waveform based at least in part on whether production of sound using the audio waveform will end before a subsequent portion of the audio stream is expected to be received.

* * * * *